US006089446A

United States Patent [19]

Hirano

[11] Patent Number: 6,089,446

[45] Date of Patent: Jul. 18, 2000

[54] CAKE CONTAINER

[75] Inventor: Kunihiro Hirano, Gifu-ken, Japan

[73] Assignee: Hirano Shiki Co., Ltd., Japan

[21] Appl. No.: 08/624,444

[22] PCT Filed: Oct. 31, 1995

[86] PCT No.: PCT/JP95/02223

§ 371 Date: Apr. 3, 1996

§ 102(e) Date: Apr. 3, 1996

[87] PCT Pub. No.: WO97/16352

PCT Pub. Date: May 9, 1997

[51] Int. Cl.[7] ..... B65D 5/24

[52] U.S. Cl. ..... 229/4.5; 47/72; 229/5.82; 229/5.84; 229/109; 229/116.1; 229/114; 229/156

[58] Field of Search ..... 229/114, 109, 229/116.1, 186, 3.1, 3.5 MF, 400, 5.82, 5.84; 47/72; 206/519

[56] References Cited

U.S. PATENT DOCUMENTS

| | | | |
|---|---|---|---|
| 1,065,486 | 6/1913 | Washburn | 229/400 |
| 1,069,675 | 8/1913 | Claussen | 229/400 |
| 1,117,848 | 11/1914 | House | 229/400 |
| 1,172,483 | 2/1916 | Rike et al. | 229/400 |
| 1,230,090 | 6/1917 | House | 229/400 |
| 1,766,226 | 6/1930 | Nias et al. | 229/400 |
| 1,807,407 | 5/1931 | Hohnhorst | 47/72 |
| 2,016,434 | 10/1935 | HUntley | 229/400 |
| 3,223,305 | 12/1965 | Edwards | 206/519 |
| 3,372,830 | 3/1968 | Edwards | 206/519 |
| 3,733,023 | 5/1973 | Arneson | 229/31 |
| 4,082,184 | 4/1978 | Hammer | 206/519 |
| 4,279,933 | 7/1981 | Austin et al. | 47/72 X |
| 4,705,209 | 11/1987 | Fujihara et al. | 229/186 X |
| 5,152,101 | 10/1992 | Weder et al. | 47/72 |
| 5,181,339 | 1/1993 | Weder et al. | 47/72 |
| 5,228,236 | 7/1993 | Weder et al. | 47/72 |
| 5,339,565 | 8/1994 | Weder et al. | 229/4.5 X |
| 5,397,051 | 3/1995 | Liu et al. | 229/186 X |

FOREIGN PATENT DOCUMENTS

| | | | |
|---|---|---|---|
| 57-36580 | 8/1982 | Japan | B65D 5/24 |
| 2-99626 | 8/1990 | Japan | B31B 49/00 |
| 1 467 451 | 3/1977 | United Kingdom . | |

*Primary Examiner*—Stephen P. Garbe
*Attorney, Agent, or Firm*—Sheridan Ross P.C.

[57] ABSTRACT

Inner folds (3) are defined on the surface of material (2) made of thin paper. The surface of the material (2) is divided by the inner folds (3) between a bottom (4) corresponding to the bottom of cake and a sidewall (5) contacting the bottom (4). Inner folds (6) and outer folds (7) are defined on the surface of the sidewall (5). A container body (1) is shaped like a cup by the inner folds (3, 6) and the outer folds (7). The sidewall is divided into a plurality of bent pieces (8, 9, 10) by the folds (6, 7). A step portion (13) intersecting the inner folds (6) and outer folds (7) to form a difference in level is defined at each bent piece (8, 9, 10). When a restoring force of the material (2) is applied to the inner folds (6) and the outer folds (7), each fold (6, 7) is about to unfold. However, each fold (6, 7) is prevented from unfolding by the step portion (13) as resistance.

7 Claims, 11 Drawing Sheets

CAKE CONTAINER

TECHNICAL FIELD

The present invention relates to a cake container, and more specifically, to a cake container for forming and maintaining cake batter that is heated to expand in a predetermined configuration.

BACKGROUND ART

Conventionally, a cup-like container formed by bending sheet material such as paper is known as a cake container for holding poundcake and the like. For example, as shown in FIG. 22, a container body 20 comprises a bottom 21 corresponding to the bottom of a cake and a sidewall 22 protruding from the periphery of the bottom 21. The container body 20 consists of a sheet of material, which is shaped like a cup by press working. A fold 23 is defined on the surface of the material. The bottom 21 and the sidewall 22 are separated by the fold 23 as a boundary. Outer folds 24 and inner folds 25 are defined on the surface of the sidewall 22. The surface of the sidewall 22 is divided into a plurality of bent pieces 26*a*–26*c* by the folds 24, 25.

Typically, aluminum foil is used as material for such a container. In this case, once the material is bent at the outer folds 24 and the inner folds 25, bent folds are easy to form. Thus, the folds 24, 25 are difficult to unfold, and the entire configuration of the sidewall 22 in the container body 20 is favorably maintained.

Meanwhile, if the material is made of synthetic resin, paper or the like, a restoring force that restores the material to its original flat shape is applied to the outer folds 24 and the inner folds 25 when the material is bent by press working. This leads to a problem in that the sidewall 22 loses its shape, and the entire configuration of the sidewall 22 cannot be properly maintained.

Accordingly, it is an object of the present invention to provide a container in which the entire configuration of the sidewall in the container body is favorably maintained by making the folds defined on the sidewall not to unfold.

DISCLOSURE OF THE INVENTION

In a cake container according to the present invention, a first fold is defined on the surface of a material made of sheet body to be press-worked. The surface of the material is divided by the first fold as a boundary between a bottom corresponding to the bottom of cake and a sidewall. Second folds are defined on the surface of the sidewall. The sidewall is divided into a plurality of bent pieces by these second folds as boundaries. Furthermore, a step portion intersecting the second folds to form a difference in level is defined at each bent piece to maintain the configuration of the sidewall. When a restoring force of the material (that tries to restore the material to the original flat sheet-shape) is applied to the second folds as bent and formed, the second folds are urged to unfold. However, the second folds are prevented from unfolding by the step portion as resistance.

BEST MODE FOR CARRYING OUT THE INVENTION

Several embodiments of a cake container according to the present invention will be described hereinafter with reference to FIGS. 1–3.

Figure 1:
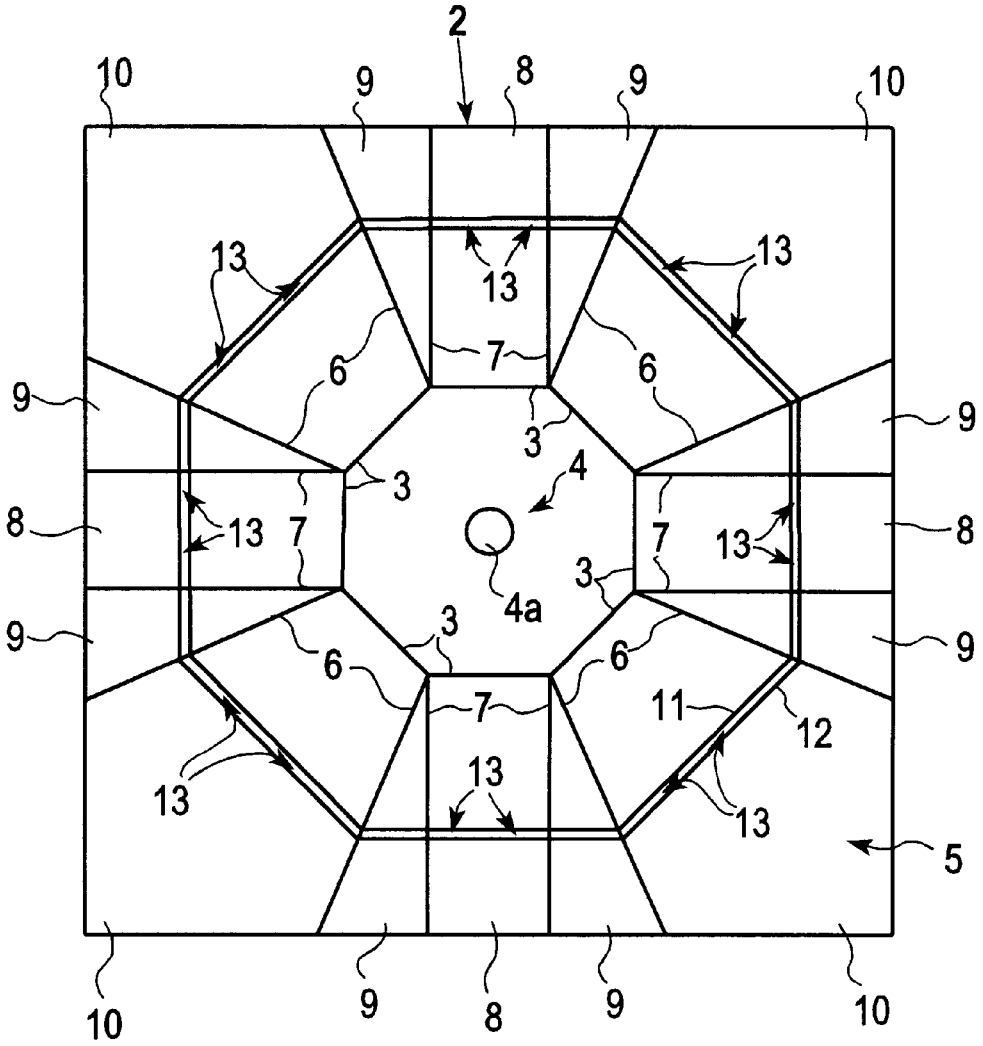
FIG. 1 is a plan view showing material in an embodiment according to the present invention.
Figure 2:
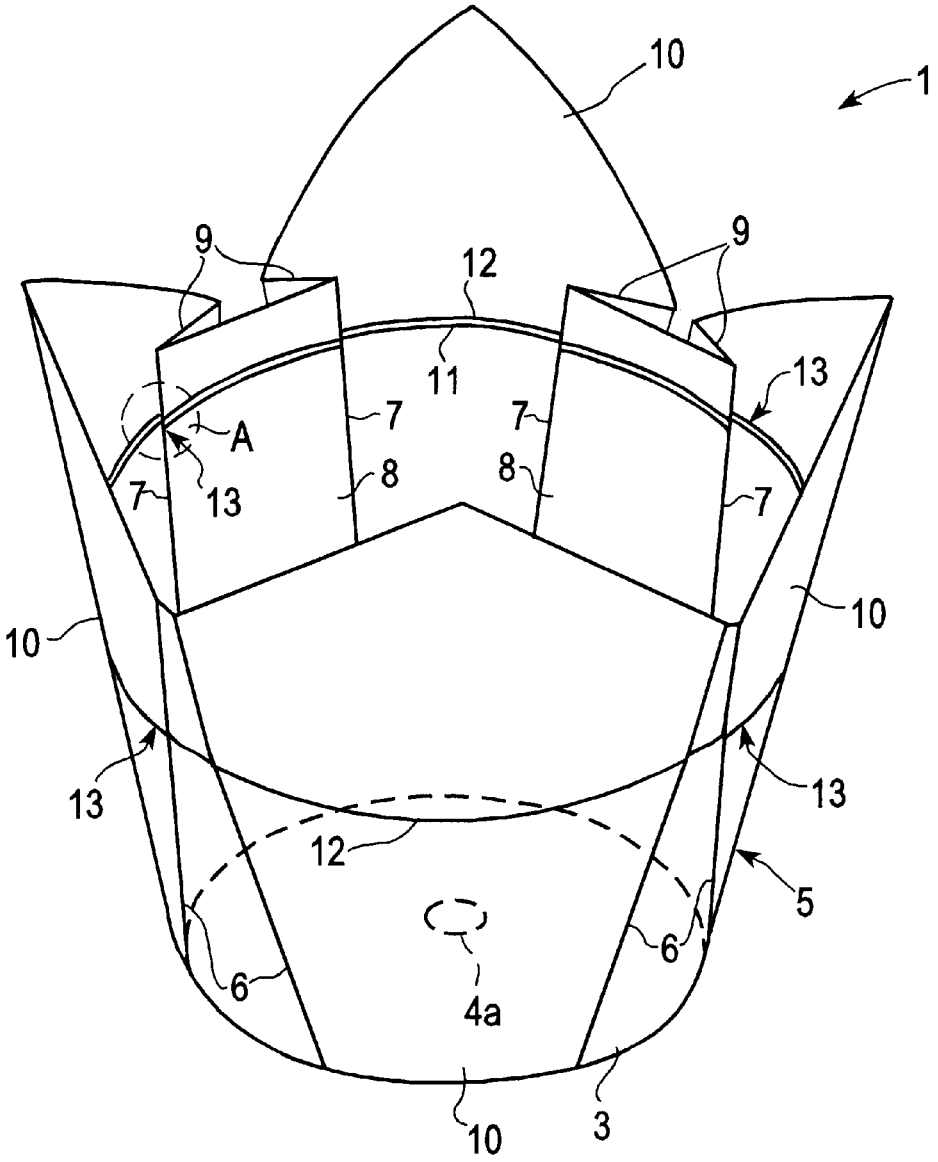
FIG. 2 is a perspective view showing a container body.
Figure 5:
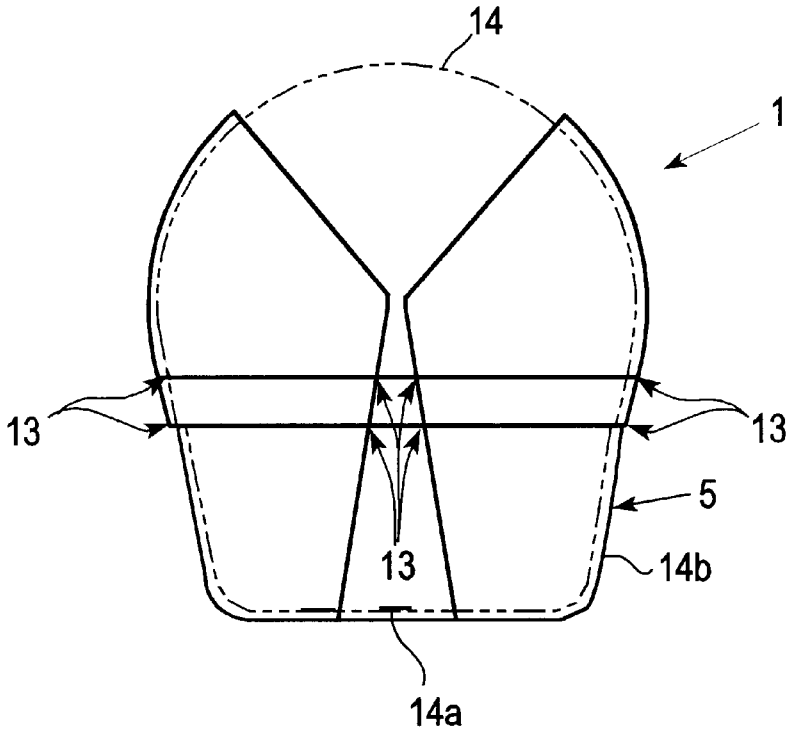
FIG. 5 is an elevational view showing the container body in FIG. 4.
Figure 6:
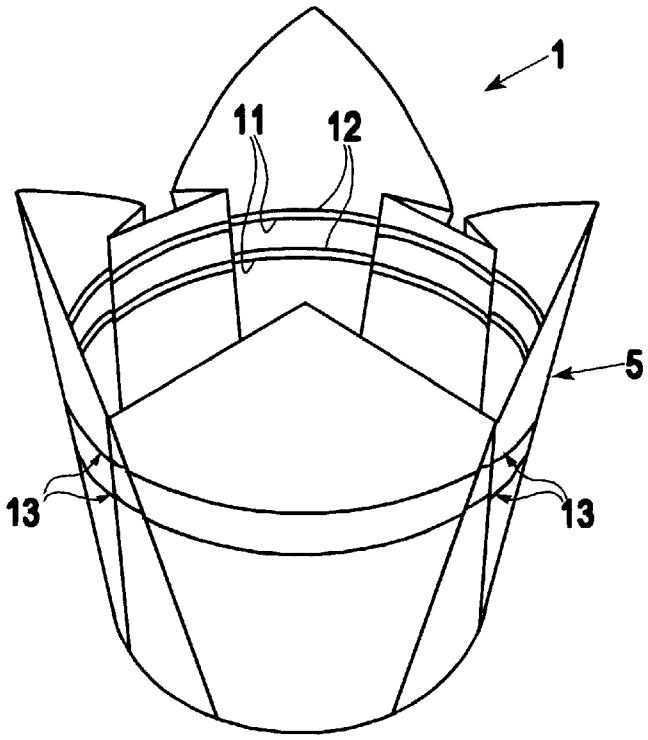
FIG. 6 is a perspective view showing the container body in FIG. 4.
Figure 7:
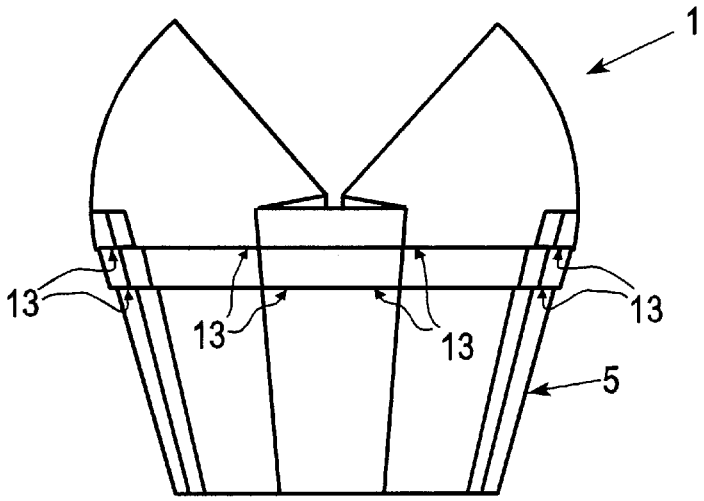
FIG. 7 is a side view showing the container body in FIG. 4.

As shown in FIGS. 1 and 2, material 2 forming a container body 1 in a circular cup-like shape is sheet-like thin paper. The material 2 has waterproofing and greaseproofing and is formed in a square shape. An octagonal inner fold 3 is formed by press working substantially in the center of the surface of the material 2. The surface of the material 2 is divided by the inner fold 3 into a bottom 4 corresponding to the bottom 14*a* of cake 14 illustrated in FIG. 5 and a sidewall 5 corresponding to the side 14*b* of the cake. A circular air hole 4*a* is formed at the center of the bottom 4. When cake batter is baked, hot air is introduced via the air hole 4*a* into the container body 1, and the cake batter is baked mellowly with the introduction of the hot air.

Inner folds 6 are formed on the surface of the material 2 corresponding to the side wall 5 by press working in such a way that the folds 6 extend diagonally from the corners of the bottom 4 joinably toward the periphery of the material 2. Likewise, outer folds 7 as second folds are formed on the surface of the material 2 corresponding to the side wall 5 by press working in such a way that the folds 7 extend from the corners of the bottom 4 orthogonally toward the periphery of the material 2. The sidewall 5 is divided by the inner folds 6 and the outer folds 7 into rectangular first bent pieces 8, triangular second bent pieces 9 and pentagonal third bent pieces 10.

In the first, second and third bent pieces 8, 9 and 10, a pair of step-like folds 11, 12 that extend parallel to the inner fold 3 and extend to intersect the inner folds 6 and the outer folds 7 are formed by press working. Each inner fold 3, 6, outer fold 7 and step-like fold 11, 12 is formed simultaneously by a single press work with one forming die. The material 2 in FIG. 1 shows the state in which it is spread out again in a sheet manner after the press work.

Figure 3:
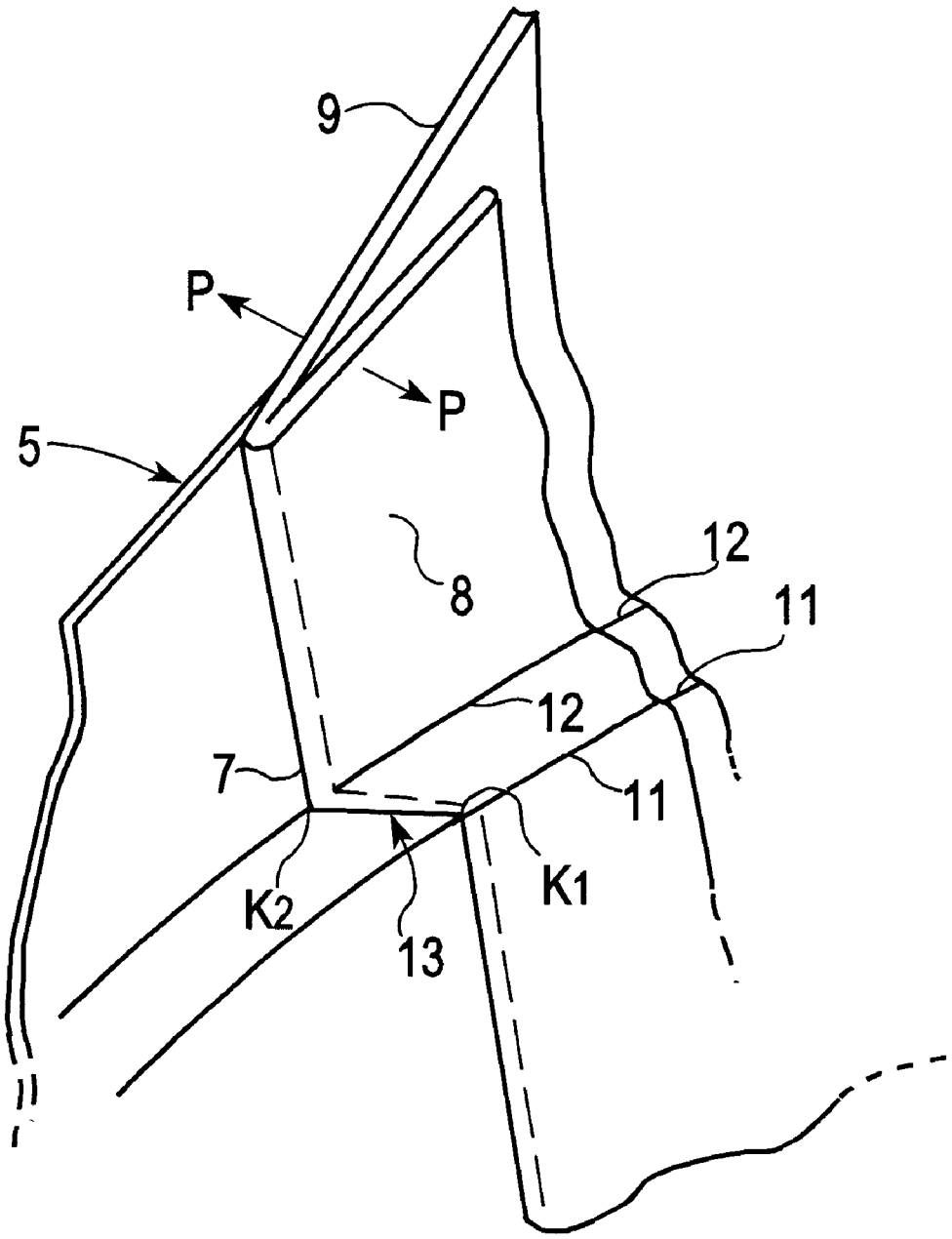
FIG. 3 is an enlarged perspective view showing a region A in FIG. 2.
Figure 4:
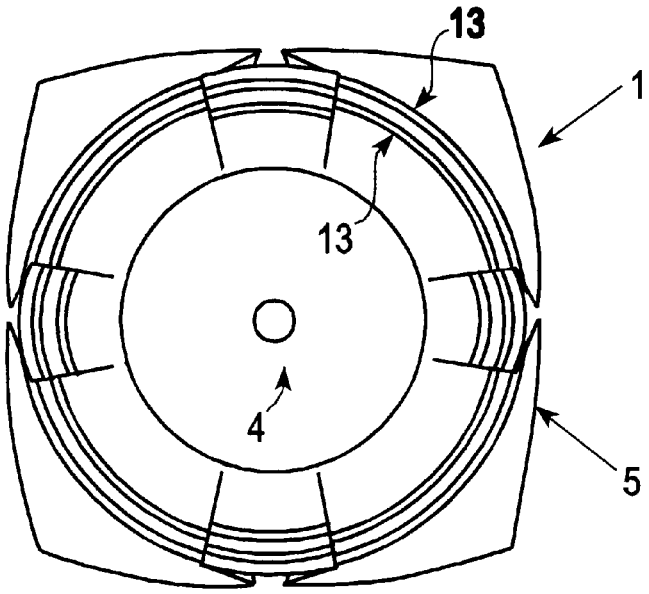
FIG. 4 is a plan view showing another embodiment of the container body provided with two step portions.

As shown in FIG. 3, a step portion 13 is defined between K1 where the inner step-like fold 11 and the inner fold 6 or outer fold 7 intersect and K2 where the outer fold 12 and the inner fold 6 or outer fold 7 intersect. More specifically, the step portion 13 is formed by the step-like folds 11, 12 and is located on the same plane at the upper part of the sidewall 5 with angles defined by the step portion 13 and each fold 6,7 being at substantially right-angles. In the present embodiment, the width of the step portion 13 is approximately 1 mm. Although the outer fold 7 that is the boundary between the first bent piece 8 and second bent piece 9 is solely shown, the inner fold 6 is not shown as the fold 6 that is the boundary between the second bent piece 9 and third bent piece 10 is composed in like manner.

In the following, the operation and effects of the cake container as composed above will be described.

When the container body 1 is formed, the sidewall 5 is bent by a one-step press work at the inner fold 3. The first bent pieces 8 and the second bent pieces 9 are folded outward at the outer folds 7. The second bent pieces 9 and the third bent pieces 10 are folded inward at the inner folds 6. Then the first, second and third bent pieces 8, 9 and 10 are respectively further bent outward at the inner step-like fold 11 and bent inward at the outer step-like fold 12. Then a step portion 13 is formed by the step-like folds 11, 12 at each inner fold 6 and outer fold 7.

As shown in FIG. 3, the restoring force that restores the bent pieces 8, 9 to their original state, i.e., a flat shape (arrows P shown in FIG. 3) is applied to the outer fold 7 defining a boundary between the first bent piece 8 and the second bent piece 9 due to the nature of the material 2, tending to unfold the bent pieces 8, 9. Although the restoring force P is also applied to the step portion 13, the outer fold 7 does not unfold as the step portion 13 operates as resistance against the restoring force P. As a result, the first and second bent pieces 8 and 9 do not unfold outward relative to the container body 1. The same is also applied to the inner fold 6 which is not shown, and the second and third bent pieces 9 and 10 do not unfold outward relative to the container body 1. As a result, deformation in which the sidewall 5 unfolds at the inner fold 6 or outer fold 7 is prevented.

As described above, in the present embodiment, the step portion 13 is provided at each inner fold 6 and outer fold 7 on the sidewall 5 of the container body 1 so that the step portion 13 can be operated as resistance against the restoring force P that operates to unfold each fold 6, 7. This prevents the first, second and third bent pieces 8, 9 and 10 on the sidewall 5 from unfolding and thus, the entire configuration of the sidewall 5 can be favorably maintained.

In addition, since the step portion 13 lies in the same plane of the sidewall 5, the resistance against the restoring force of the material 2 is applied uniformly along the periphery of the sidewall 5. Thus, the sidewall 5 is prevented from deforming more reliably.

Furthermore, the first, second and third bent pieces 8, 9 and 10 do not need adhering to one another with adhesive in order to maintain the configuration of the sidewall 5. Thus, the sidewall 5 can be easily unfolded, and the cake 14 is easy to eat.

In the present embodiment, the following effects can be achieved as the material 2 is made of thin paper.

In case a foreign metal substance is mixed in the cake batter to be contained in the container body 1, the foreign metal substance can be detected by a metal detector unlike the case in which the container body 1 is made of aluminum foil.

Additionally, when the cake batter contained in the container body 1 is baked, heat of an oven is difficult to diffuse as compared with a container made of aluminum foil. Thus, the time for baking cake batter is reduced.

Moreover, unlike an aluminum foil container the cake batter can be baked with a microwave range in addition to an oven. Thus, a variety of baking methods can be selected depending on the nature of the cake batter.

In addition, material cost can be more reduced in thin paper than in aluminum foil, thereby reducing the overall manufacturing cost of the container body 1. Moreover, when the unnecessary material 2 is disposed of, the incineration efficiency of the material 2 made of thin paper is higher as the material 2 can be incinerated at a lower temperature than aluminum foil.

Furthermore, writing or illustrations can be printed on the outer surface of the sidewall 5 as thin paper is used, thereby improving the attractiveness of the container body 1.

The present invention can be embodied as follows in addition to the above-mentioned embodiment.

Figure 8:
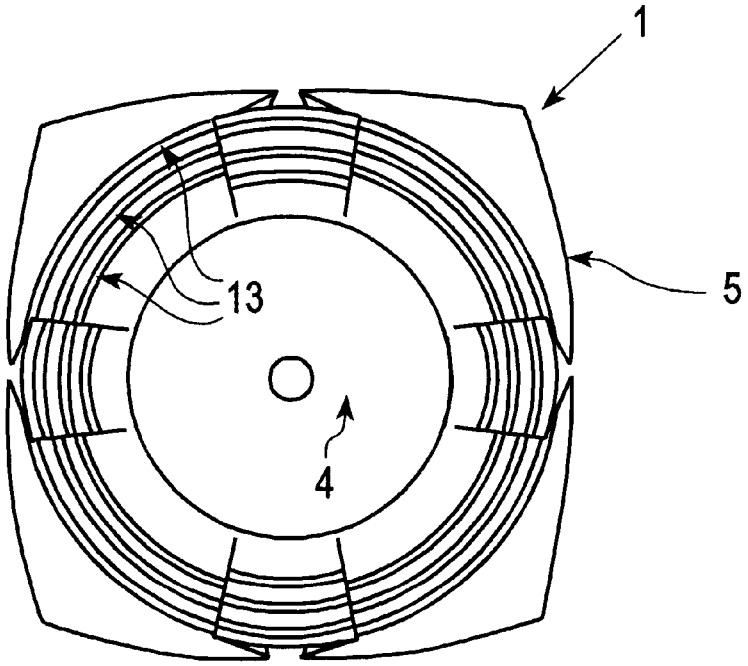
FIG. 8 is a plan view showing another embodiment of the container body provided with three step portions.
Figure 9:
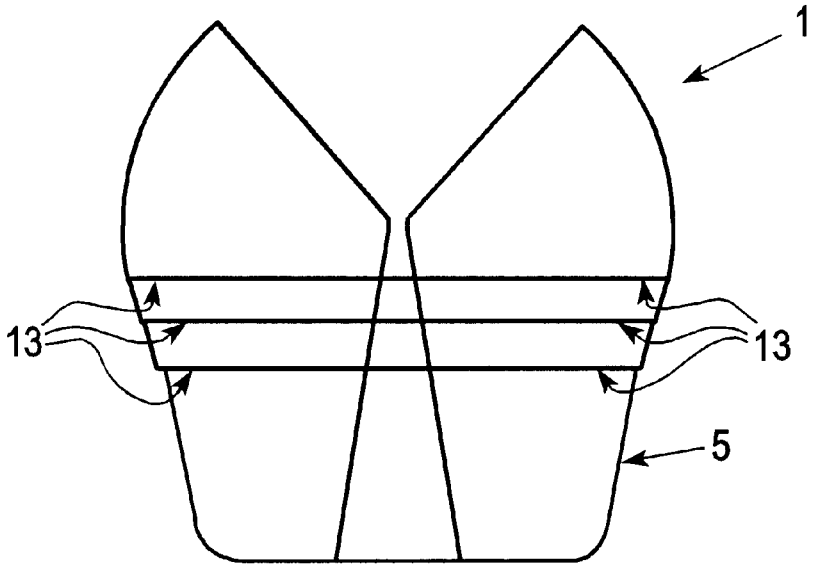
FIG. 9 is an elevational view showing the container body in FIG. 8.
Figure 10:
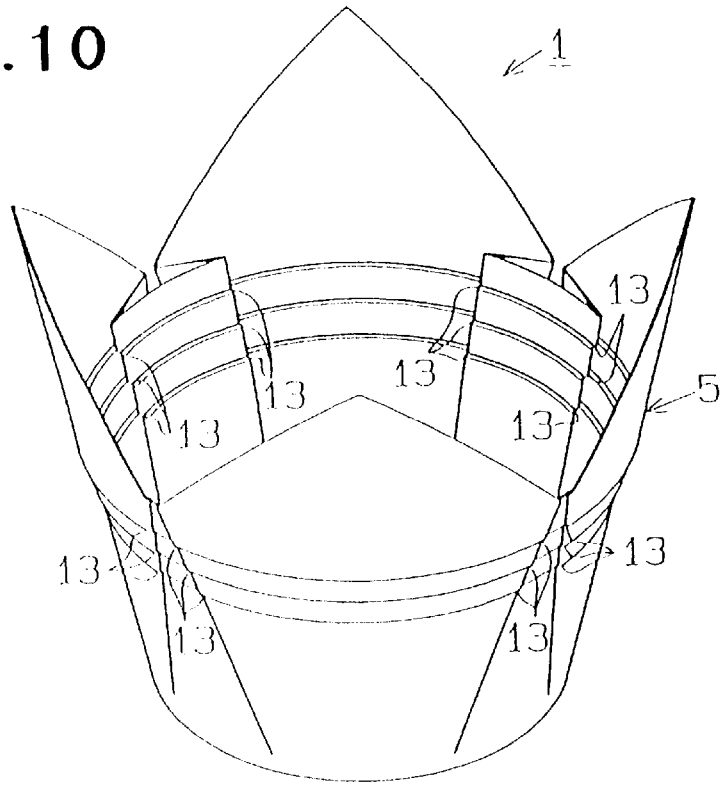
FIG. 10 is a perspective view showing the container body in FIG. 8.

In the above embodiment, one step portion 13 is defined by a pair of step-like folds 11, 12. The number of step portion 13 may be two as illustrated in FIGS. 4–7 or may be three as shown in FIGS. 8–10. These constructions enhance resistance against the restoring force P of the material 2, thereby further preventing the sidewall 5 from deforming by unfolding. In the above embodiment, the inner fold 3 is defined at the boundary between the bottom 4 and the sidewall 5. The inner fold 3 may be omitted by curving the boundary between the bottom 4 and the sidewall 5. Furthermore, a plurality of step portions 13 may be provided in succession along the height of the container body 1 instead of at a predetermined location, which is not shown.

Figure 11:
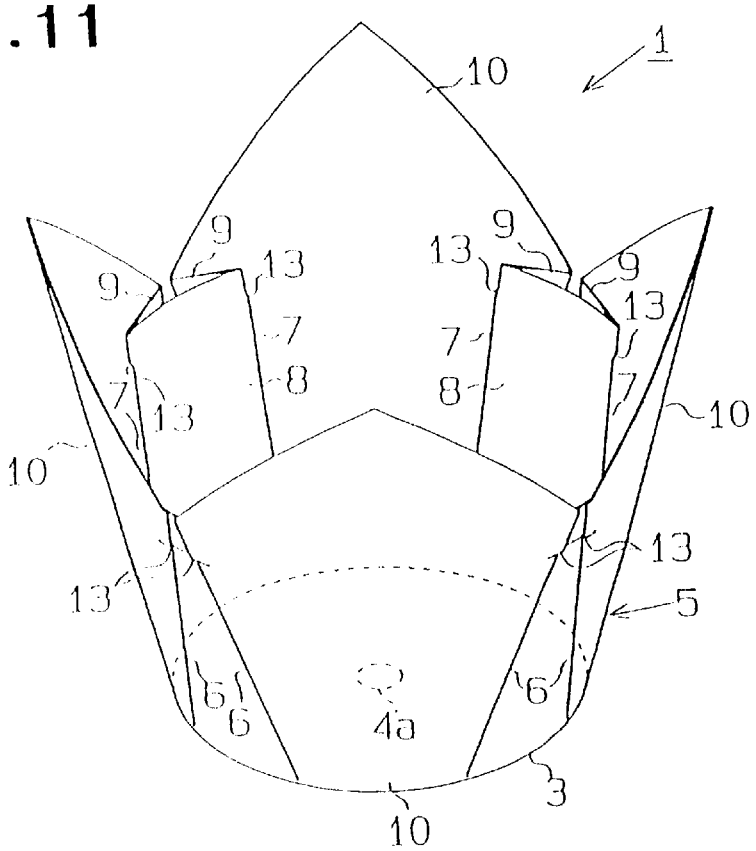
FIG. 11 is a perspective view showing another embodiment of the container body provided with step portions solely at the outer folds and the inner holds on the sidewall of the container body.

In the above embodiment, a step portion 13 is defined at the inner folds 6 and the outer folds 7 by the step-like folds 11, 12 formed annularly relative to the first, second and third bent pieces 8, 9 and 10. As illustrated in FIG. 11, step portions 13 may be defined solely at the inner folds 6 and the outer folds 7 instead of forming the step-like folds 11, 12 annularly. This construction also achieves the same effects as the above embodiment.

Figure 12:
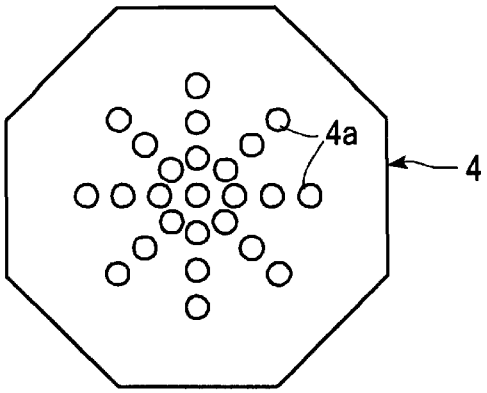
FIG. 12 is a plan view solely showing the bottom of the container body having a plurality of air holes disposed radially in another embodiment of the container body.
Figure 13:
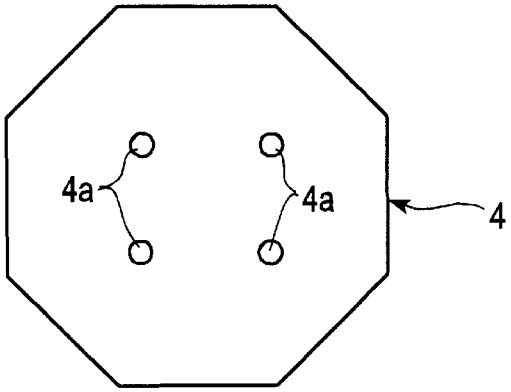
FIG. 13 is a plan view solely showing the bottom of the container body having four circular air holes in another embodiment of the container body.
Figure 14:
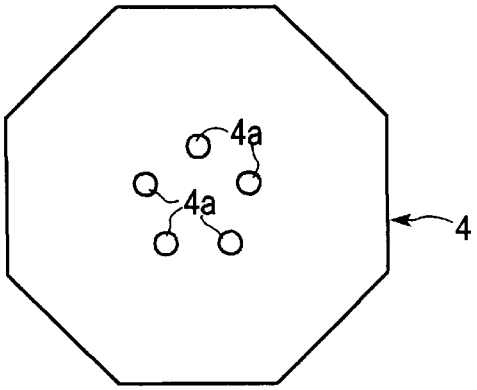
FIG. 14 is a plan view solely showing the bottom of the container body having five circular air holes in another embodiment of the container body.
Figure 15:
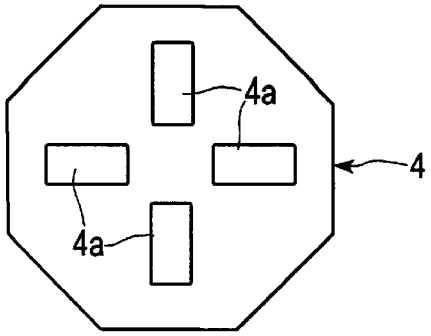
FIG. 15 is a plan view solely showing the bottom of the container body having four rectangular air holes in another embodiment of the container body.
Figure 16:
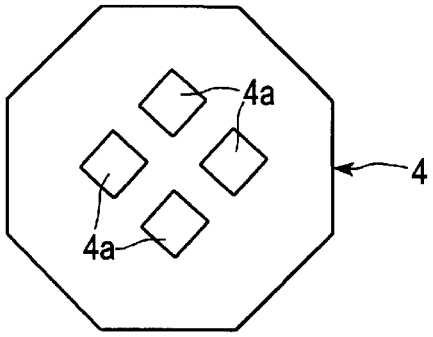
FIG. 16 is a plan view solely showing the bottom of the container body having four square air holes in another embodiment of the container body.
Figure 17:
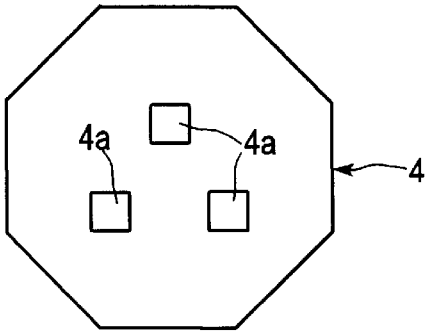
FIG. 17 is a plan view solely showing the bottom of the container body having three square air holes in another embodiment of the container body.
Figure 18:
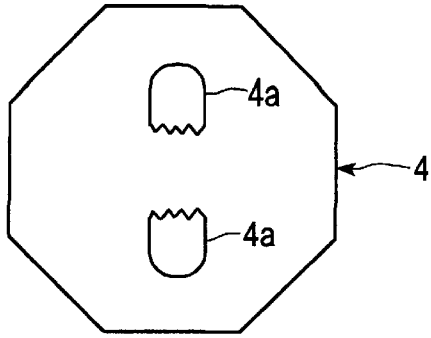
FIG. 18 is a plan view solely showing the bottom of the container body having two air holes in another embodiment of the container body.

In the above embodiment, one circular air hole 4*a* is defined in the center of the bottom 4 of the container body 1. As shown in FIG. 12, a plurality of air holes 4*a* extending radially from the center of the bottom 4 outward may be defined. As illustrated in FIG. 13, four air holes 4*a* may be defined at equal distances at the same plane having the center of the bottom 4. Furthermore, as illustrated in FIG. 14, five air holes 4*a* may be defined at equal distances at the same plane having the center of the bottom 4. In addition, as shown in FIG. 15, the air holes 4*a* shown in FIG. 13 may be rectangular or may be square as shown in FIG. 16. Moreover, the number of air holes 4*a* shown in FIG. 16 may be three. As shown in FIG. 18, the number of air holes 4*a* may be two, where part of the air hole 4*a* is formed in a saw-like manner. In addition to the air holes 4*a* shown in FIGS. 12–18, air holes 4*a* may be shaped arbitrarily, or the number of air holes 4*a* may be modified arbitrarily.

Figure 19:
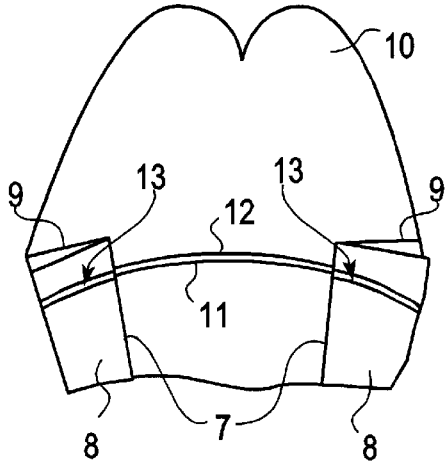
FIG. 19 is a cutaway perspective view showing part of the container body having the upper end of the third bent piece notched in a constricted manner.
Figure 20:
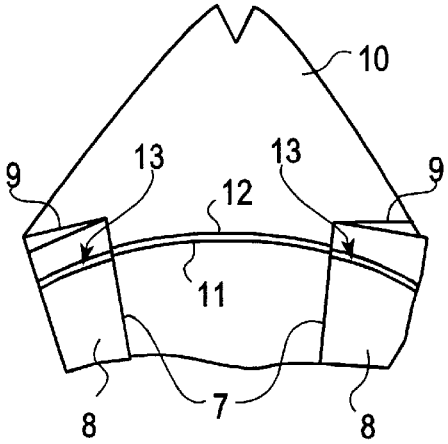
FIG. 20 is a cutaway perspective view showing part of the container body having the upper end of the third bent piece notched in a right-angled manner.
Figure 21:
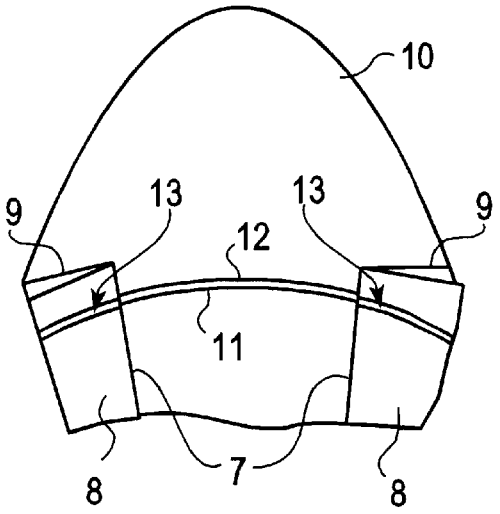
FIG. 21 is a cutaway perspective view showing part of the container body having the upper end of the third bent piece notched in a curved manner.
Figure 22:
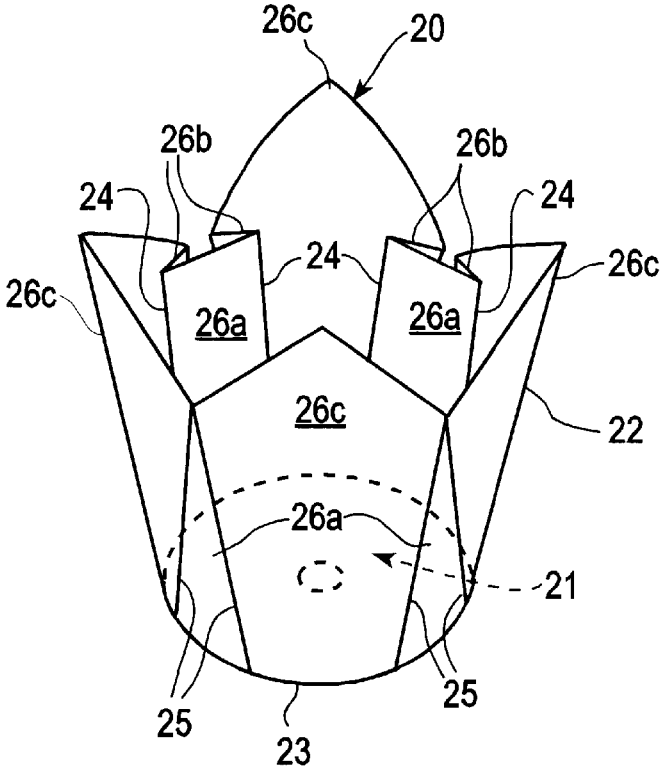
FIG. 22 is a perspective view showing a prior art cake container.

In the above embodiment, the upper end of the third bent piece 10 on the sidewall 5 is shaped in a right-angled manner. As illustrated in FIG. 19, the upper end of the third bent piece 10 may be notched in a tapered manner. As shown in FIG. 20, the upper end of the third bent piece 10 may be notched in a right-angled manner. Furthermore, as shown in FIG. 21, the upper end of the third bent piece 10 may be rounded.

In the above embodiment, the step portion 13 is positioned at the same plane of the sidewall 5. The step portion 13 may be arranged in a zigzag pattern as long as it intersects the inner folds 6 and outer folds 7.

In the above embodiment, the step portion 13 is bent toward the outside of the container body 1, and outside of the step portion 13 are arranged bent pieces 8–10. These positional relationships may be reversed. Such a construction also achieves the same effects as that of the above embodiment.

In the above embodiment, the container body 1 is shaped like a circular cup. The container body 1, for example, may be formed in a arbitrarily shaped cup such as a triangular cup, a square cup or the like.

In the above embodiment, thin paper having waterproofing and oilproofing is used as the material 2. In addition to the material 2 having such properties, kraft paper, kraft extensible paper having micro crepe (microscopic wrinkles), machine glazed paper having a gloss on one surface, India paper, paraffin paper, tarpaulin, duplex asphalt paper, Japanese paper or the like may be used. Besides paper, cellophane, moisture proof cellophane, plastic film, polyethylene film, polypropylene film, polyvinyl chloride film, polyvinylidene chloride film, polyester film, polystyrene film, nylon film, polyvinyl alcohol film, polycarbonate film may be used. Furthermore, film type synthetic paper and synthetic paper with synthetic pulp as its raw material may also be used. In addition, aluminum foil may be used, or aluminum foil may be adhered to the above paper or film. The quality of the material of the material 2 may be modified in any form in addition to the quality of the material described above.

The container body 1 may be embodied so that the inner folds 6 are outer folds and that the outer folds 7 are inner folds.

Preferably, the size of the material 2 in the above embodiment is in the range from 10 cm×10 cm to 20 cm×20 cm. The size may be arbitrarily determined without being restricted specifically to this range.

The thickness of the material 2 in the above embodiment may be arbitrarily determined.

In the above embodiment, the material 2 shaped like a square is used. The material may be arbitrarily changed so that it is shaped in a circular, rectangular or elliptical manner without being limited to the square shape.

In the present embodiment, the width of the step portion 13 is approximately 1 mm. Although it varies depending on the thickness, quality of the material and size of the material 2, the width of the step portion 13 is preferably in the range from 0.2 mm to 5.0 mm. The width of the step portion may be arbitrarily determined without being restricted specifically to this range.

I claim:

1. A cup-like container comprising a sheet material, said sheet material forming:

a bottom portion;

a side wall continuous with the bottom portion, wherein the side wall includes:

a plurality of folds for defining a plurality of bent pieces, wherein the folds and the bent pieces create multilayered sections of the side wall that are formed by overlapping of the bent portions; and a plurality of step portions that extend traversely across the plurality of folds, wherein a portion of each fold extends above and below each step portion, wherein the step portions are arranged in a multiple-step manner, each step portion extending continuously about the periphery of the container.

2. The cup-like container of claim 1, wherein the side wall includes single layer portions located between the multilayered portions, and wherein the step portion extends continuously through the multilayered sections of the side wall and through single layer portions of the side wall.

3. A cup-like container comprising:

a sheet material, said material forming:

a bottom portion, said bottom portion having an air hole for introducing hot air; and a side wall continuous with said bottom portion, said side wall having a plurality of folds for defining a plurality of bent pieces having a step portion extending transversely of said respective folds.

4. The cup-like container as set forth in claim 3, wherein the air hole has a circular shape.

5. The cup-like container as set forth in claim 3, wherein the air hole is one of a plurality of air holes formed in the bottom portion.

6. The cup-like container as set forth in claim 5, wherein each air hole has a circular shape.

7. A method for forming a cup-like container, comprising the steps of:

providing a sheet material;

folding the sheet material to form:

a bottom portion, a side wall continuous with the bottom portion, and a plurality of folds in the sidewall for defining a plurality of bent pieces; and forming a plurality of step portions extending transversely across the plurality of folds, wherein:

a portion of each fold extends above each step portion and below each step portion, and the plurality of step portions is arranged in a multiple-step manner.

* * * * *